US009608312B2

(12) United States Patent
Gu et al.

(10) Patent No.: US 9,608,312 B2
(45) Date of Patent: Mar. 28, 2017

(54) WIDEBAND ANTENNA FOR MOBILE SYSTEM WITH METAL BACK COVER

(71) Applicant: BLACKBERRY LIMITED, Waterloo (CA)

(72) Inventors: Huanhuan Gu, Kitchener (CA); Houssam Kanj, Waterloo (CA); Shirook M. Ali, Milton (CA)

(73) Assignee: BLACKBERRY LIMITED, Waterloo, Ontario (CA)

( * ) Notice: Subject to any disclaimer, the term of this patent is extended or adjusted under 35 U.S.C. 154(b) by 129 days.

(21) Appl. No.: 14/486,772

(22) Filed: Sep. 15, 2014

(65) Prior Publication Data

US 2016/0079655 A1 Mar. 17, 2016

(51) Int. Cl.

| | |
|---|---|
| ***H01Q 1/24*** | (2006.01) |
| ***H01Q 9/04*** | (2006.01) |
| ***H01Q 9/42*** | (2006.01) |
| *H01Q 13/10* | (2006.01) |

(52) U.S. Cl.

CPC ..... *H01Q 1/243* (2013.01); *H01Q 9/0421* (2013.01); *H01Q 9/42* (2013.01); *H01Q 13/10* (2013.01)

(58) Field of Classification Search

CPC ..... H01Q 1/243; H01Q 13/10; H01Q 9/0421
USPC ..... 343/700 MS, 702
See application file for complete search history.

(56) References Cited

U.S. PATENT DOCUMENTS 6,924,770 B2 * 8/2005 Carpenter ..... H01Q 1/243 343/700 MS
8,890,766 B2 * 11/2014 Huynh ..... H01Q 9/0442 343/700 MS
2007/0063901 A1 * 3/2007 Tang ..... H01Q 9/40 343/702
2009/0153407 A1 * 6/2009 Zhang ..... H01Q 1/243 343/702
2011/0193752 A1 * 8/2011 Wang ..... H01Q 1/243 343/702
2013/0069836 A1 * 3/2013 Bungo ..... H01Q 1/243 343/724
2013/0257659 A1 * 10/2013 Darnell ..... H01Q 1/243 343/702

(Continued)

FOREIGN PATENT DOCUMENTS

CN 203466294 U 3/2014

OTHER PUBLICATIONS

Extended European Search Report dated Feb. 1, 2016 for European Patent Application No. 15184722.5.

*Primary Examiner* — Dameon E Levi
*Assistant Examiner* — Ab Salam Alkassim, Jr.
(74) *Attorney, Agent, or Firm* — Perry + Currier, Inc.

(57) ABSTRACT

A device is set forth, comprising: a metallic back cover having interior and exterior portions; a chassis disposed on the interior portion of said metallic back cover for mounting components; a metallic edge ring surrounding said metallic back cover and said chassis; a gap extending through the exterior portion of the back cover and through the edge, for defining one dimension of an antenna conducting plane; a ground plane covering the chassis such that said antenna conducting plane and ground plane wrap around the chassis and components mounted thereon; an antenna feed extending through the ground plane to the antenna conducting plane; and a shorting pin connecting the ground plane to the antenna conducting plane.

15 Claims, 11 Drawing Sheets

(56) References Cited

U.S. PATENT DOCUMENTS

| | | | | |
|---|---|---|---|---|
| 2013/0300626 | A1* | 11/2013 | Lee | H01Q 1/50 343/850 |
| 2014/0009355 | A1* | 1/2014 | Samardzija | H01Q 1/42 343/789 |
| 2014/0125528 | A1* | 5/2014 | Tsai | H01Q 13/106 343/702 |
| 2015/0057054 | A1* | 2/2015 | Su | H01Q 1/243 455/575.7 |

* cited by examiner

WIDEBAND ANTENNA FOR MOBILE SYSTEM WITH METAL BACK COVER

FIELD

The specification relates generally to antennas, and specifically to a wideband antenna for metal back mobile system applications.

BACKGROUND

The presence of metal parts on the exterior of mobile devices is becoming increasingly prevalent for reasons of aesthetics and mechanical sturdiness. 4G mobile devices are required to operate over the GSM850/900/1800/1900 UMTS bands (824-896/880-960/1710-1880/1850-1990/1920-2170 MHz) as well as the LTE700/2300/2500 bands (698-787/2305-2400/2500-2690 MHz), which can be grouped as follows: low band (698-960 MHz), middle band (1710-2170 MHz), and high band (2300-2690 MHz). Further, the LTE Advanced standard requires carrier aggregation, i.e., two carriers that may be non-contiguous being aggregated to increase the data rate. The requirements for tri-band operation and accommodating carrier aggregation give rise to challenges in fitting antennas into a compact phone design with multi-operating frequencies, and good diversity and capacity performance.

BRIEF DESCRIPTIONS OF THE DRAWINGS

For a better understanding of the various implementations described herein and to show more clearly how they may be carried into effect, reference will now be made, by way of example only, to the accompanying drawings in which.

DETAILED DESCRIPTION

Figure 1:
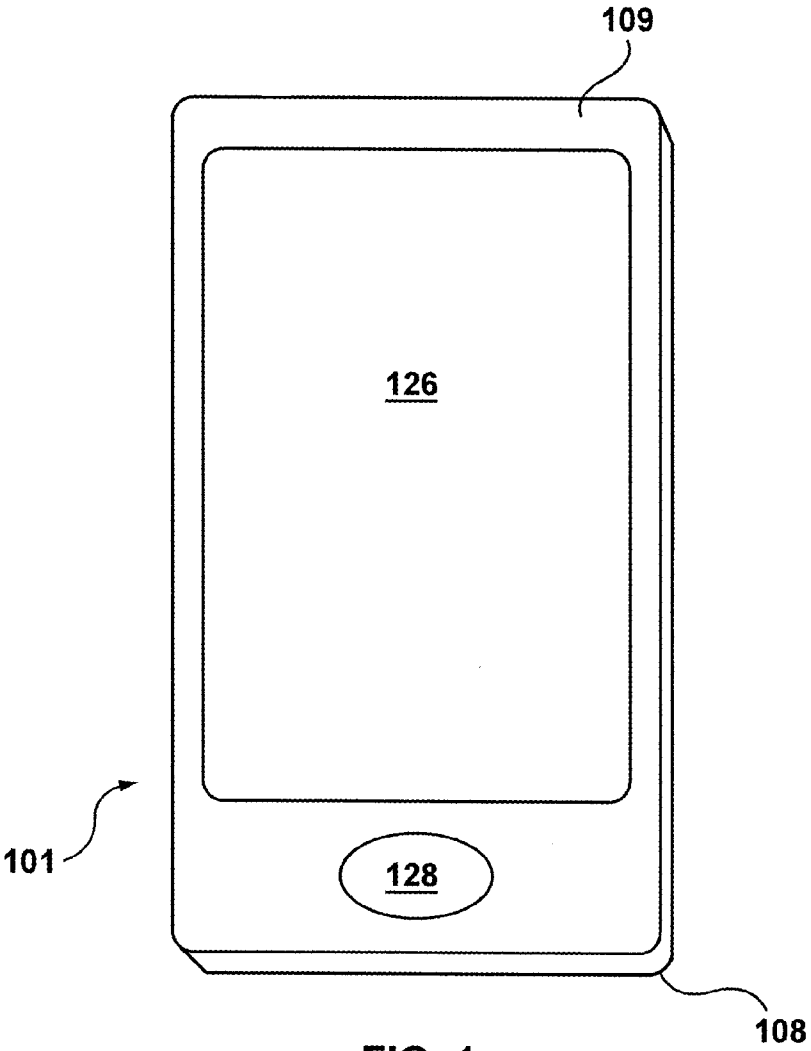
FIG. 1 depicts a front perspective view of a device that includes a wideband antenna for metal back mobile handsets, according to a non-limiting implementation.

The present disclosure describes examples of devices with a predominantly metal and/or predominantly conducting back cover in the form of a conducting portion of the back cover. In such devices, a tri-band antenna is located in the interior of the device, for example on an internal chassis, behind the back cover, though connections to an antenna feed and/or a ground plane can run at least partially behind a conducting portion of the back cover. For example, the conducting portion can comprise a portion of the back cover that is separated from the remainder of the back cover by a gap that separates the conducting portions. Each tri-band antenna can operate in three different frequency ranges including, but not limited to, 698-960 MHz, 1710-2170 MHz and 2300-2690 MHz.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

Furthermore, as will become apparent, in this specification certain elements may be described as connected physically, electronically, or any combination thereof, according to context. In general, components that are electrically connected are configured to communicate (that is, they are capable of communicating) by way of electric signals. According to context, two components that are physically coupled and/or physically connected may behave as a single element. In some cases, physically connected elements may be integrally formed, e.g., part of a single-piece article that may share structures and materials. In other cases, physically connected elements may comprise discrete components that may be fastened together in any fashion. Physical connections may also include a combination of discrete components fastened together, and components fashioned as a single piece.

Furthermore, as will become apparent in this specification, certain antenna components may be described as being configured for generating a resonance at a given frequency and/or resonating at a given frequency and/or having a resonance at a given frequency. In general, an antenna component that is configured to resonate at a given frequency, and the like, can also be described as having a resonant length, a radiation length, a radiating length, an electrical length, and the like, corresponding to the given frequency. The electrical length can be similar to, or different from, a physical length of the antenna component. The electrical length of the antenna component can be different from the physical length, for example by using electronic components to effectively lengthen the electrical length as compared to the physical length. The term electrical length is most often used with respect to simple monopole and/or dipole antennas. The resonant length can be similar to, or different from, the electrical length and the physical length of the antenna component. In general, the resonant length corresponds to an effective length of an antenna component used to generate a resonance at the given frequency; for example, for irregularly shaped and/or complex antenna components that resonate at a given frequency, the resonant length can be described as a length of a simple antenna component, including but not limited to a monopole antenna and a dipole antenna, that resonates at the same given frequency.

According to a first non-limiting aspect, a device is provided comprising:

a back cover having a conducting central portion and a further conducting portion on an exterior thereof, the further conducting portion being separated from the central portion by a gap;

a conducting ground plane interior to said back cover;

an interior chassis adjacent the conducting ground plane;

a metal edge ring surrounding the interior chassis and having a portion separated by said gap, wherein the portion separated by said gap and the further conducting portion on the exterior of the back cover comprise an antenna conducting plane;

an antenna feed connected to the antenna conducting plane; and a shorting pin connecting the ground plane to the antenna conducting plane.

According to a further non-limiting aspect, a device is provided comprising:

a metallic back cover having interior and exterior portions;

a chassis disposed on the interior portion of said metallic back cover for mounting components;

a metallic edge ring surrounding said metallic back cover and said chassis;

a gap extending through the exterior portion of the back cover and through the edge, for defining one dimension of an antenna conducting plane;

a ground plane covering the chassis such that said antenna conducting plane and ground plane wrap around the chassis and components mounted thereon;

an antenna feed extending through the ground plane to the antenna conducting plane; and a shorting pin connecting the ground plane to the antenna conducting plane.

Figure 2:
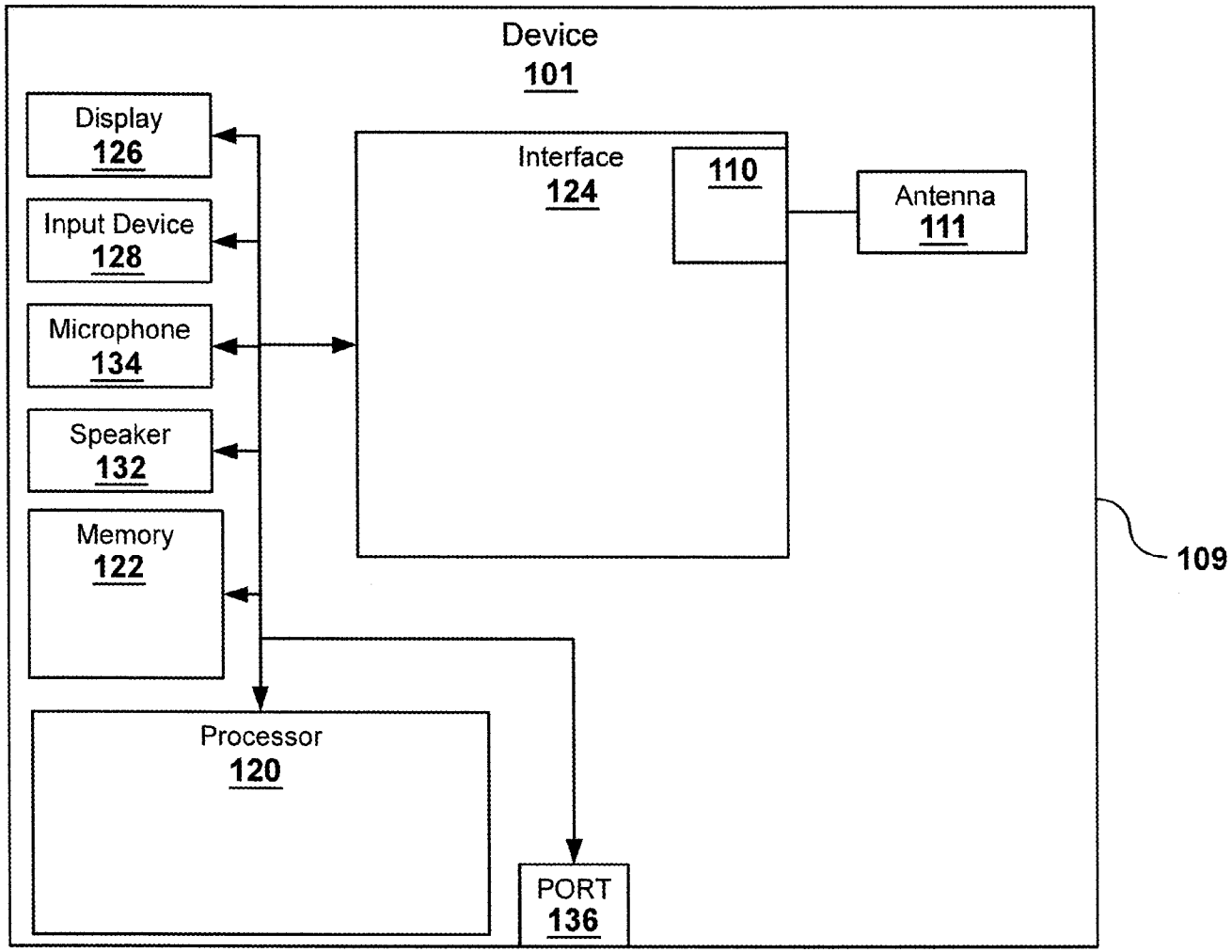
FIG. 2 depicts a schematic diagram of the device of FIG. 1, according to a non-limiting implementation.

FIGS. 1 and 2 respectively depict a front perspective view and a schematic diagram of a mobile electronic device 101, referred to interchangeably hereafter as device 101. Device 101 comprises: a chassis 109; a metal edge ring 108 surrounding the chassis; an antenna feed 110 and an antenna 111. Physical configurations of device 101 and antenna 111 will be described in further detail below.

Device 101 can be any type of electronic device that can be used in a self-contained manner to communicate with one or more communication networks using antenna 111. Device 101 can include, but is not limited to, any suitable combination of electronic devices, communications devices, computing devices, personal computers, laptop computers, portable electronic devices, mobile computing devices, portable computing devices, tablet computing devices, laptop computing devices, desktop phones, telephones, PDAs (personal digital assistants), cellphones, smartphones, e-readers, internet-enabled appliances and the like. Other suitable devices are within the scope of present implementations. Device 101 further comprises a processor 120, a memory 122, a display 126, a communication interface 124 that can optionally comprise antenna feed 110 and/or switch 115, at least one input device 128, a speaker 132 and a microphone 134.

It should be emphasized that the shape and structure of device 101 in FIGS. 1 and 2 are purely examples, and contemplate a device that can be used for both wireless voice (e.g. telephony) and wireless data communications (e.g. email, web browsing, text, and the like). However, FIG. 1 contemplates a device that can be used for any suitable specialized functions, including, but not limited, to one or more of, telephony, computing, appliance, and/or entertainment related functions.

With reference to FIG. 1, an exterior of device 101 is depicted with a front portion of chassis 109 surrounded by edge ring 108, the corners of chassis 109 and edge ring 108 being generally square though, in other implementations, the corners can be rounded and/or any other suitable shape; indeed, the shape and configuration of device 101 depicted in FIG. 1 is merely an example and other shapes and configurations are within the scope of present implementations.

With reference to FIGS. 1 and 2, device 101 comprises at least one input device 128 generally configured to receive input data, and can comprise any suitable combination of input devices, including but not limited to a keyboard, a keypad, a pointing device (as depicted in FIG. 1), a mouse, a track wheel, a trackball, a touchpad, a touch screen and the like. Other suitable input devices are within the scope of present implementations.

Input from input device 128 is received at processor 120 (which can be implemented as a plurality of processors, including but not limited to one or more central processors (CPUs)). Processor 120 is configured to communicate with a memory 122 comprising a non-volatile storage unit (e.g. Erasable Electronic Programmable Read Only Memory ("EEPROM"), Flash Memory) and a volatile storage unit (e.g. random access memory ("RAM")). Programming instructions that implement the functional teachings of device 101 as described herein are typically maintained, persistently, in memory 122 and used by processor 120 which makes appropriate utilization of volatile storage during the execution of such programming instructions. Those skilled in the art will now recognize that memory 122 is an example of computer readable media that can store programming instructions executable on processor 120. Furthermore, memory 122 is also an example of a memory unit and/or memory module.

Memory 122 is an example of a computer program product, comprising a non-transitory computer usable medium having a computer readable program code adapted to be executed to implement a method.

Processor 120 can be further configured to communicate with display 126, and microphone 134 and speaker 132. Display 126 comprises any suitable one of, or combination of, flat panel displays (e.g. LCD (liquid crystal display), plasma displays, OLED (organic light emitting diode) displays, capacitive or resistive touchscreens, CRTs (cathode ray tubes)) and the like. Microphone 134 comprises any suitable microphone for receiving sound and converting to audio data. Speaker 132 comprises any suitable speaker for converting audio data to sound to provide one or more of audible alerts, audible communications from remote communication devices, and the like. In some implementations, input device 128 and display 126 are external to device 101, with processor 120 in communication with each of input device 128 and display 126 via a suitable connection and/or link.

Processor 120 also connects to communication interface 124 (interchangeably referred to as interface 124), which can be implemented as one or more radios and/or connectors and/or network adaptors, configured to wirelessly communicate with one or more communication networks (not depicted) via antenna 111. It will be appreciated that interface 124 is configured to correspond with network architecture that is used to implement one or more communication links to the one or more communication networks, including but not limited to any suitable combination of USB (universal serial bus) cables, serial cables, wireless links, cellphone links, cellular network links (including but not limited to 2G, 2.5G, 3G, 4G+ such as UMTS (Universal Mobile Telecommunications System), GSM (Global System for Mobile Communications), CDMA (Code division multiple access), FDD (frequency division duplexing), LTE (Long Term Evolution), TDD (time division duplexing), TDD-LTE (TDD-Long Term Evolution), TD-SCDMA (Time Division Synchronous Code Division Multiple Access)) and the like), wireless data, Bluetooth™ links, NFC (near field communication) links, WLAN (wireless local area network) links, WiFi links, WiMax links, packet based links, the Internet, analog networks, the PSTN (public switched telephone network), access points, and the like, and/or a combination.

Specifically, interface 124 comprises radio equipment (i.e. a radio transmitter and/or radio receiver) for receiving and transmitting signals using antenna 111. It is further appreciated that, as depicted, interface 124 includes antenna feed 110.

As depicted, device 101 further comprises a port 136 which can include, but is not limited to a USB (Universal Serial Bus) port.

As discussed below with reference to FIG. 3, device 101 can further comprise a ground plane that can be connected to antenna 111.

While not depicted, device 101 further comprises a power source, for example a battery or the like. In some implementations the power source can comprise a connection to a mains power supply and a power adaptor (e.g. an AC-to-DC (alternating current to direct current) adaptor).

In any event, it should be understood that a wide variety of configurations for device 101 are contemplated.

Furthermore, antenna 111 can be configured to operate in at least three frequency bands. A first one of the at least three frequency ranges can comprise one or more of: a frequency range of about 698 MHz to about 960 MHz; an LTE (Long-Term Evolution) frequency range; and LTE700 frequency range. A second one of the at least three frequency ranges can comprise one or more of: about 1710 to about 2170 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range. A third one of the at least three frequency ranges comprises one or more of: about 2300 to about 2690 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range.

In other words, antenna 111 can comprise a MIMO (multiple-in-multiple-out) tri-band antenna.

Figure 3:
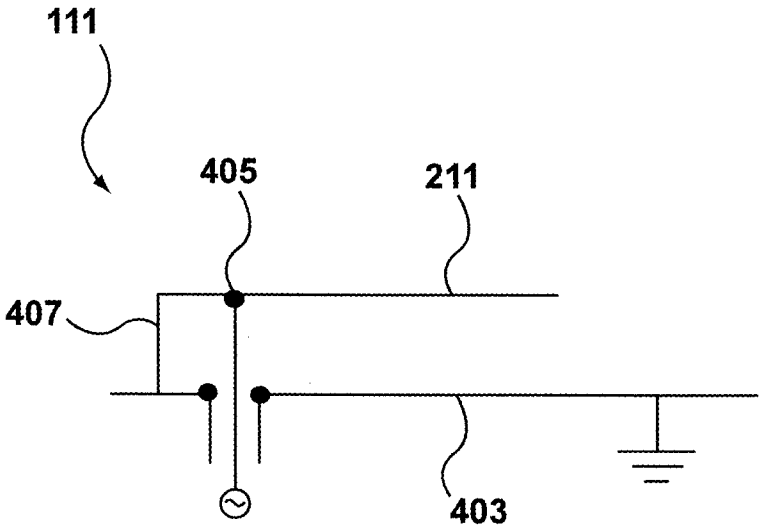
FIG. 3 is a circuit drawings of a planar inverted F-antenna (PIFA), according to a non-limiting implementation.

In one embodiment, antenna 111 is a planar inverted F-antenna (PIFA), as depicted in FIG. 3, which is characterized by a low profile, an omnidirectional pattern, and good SAR properties. A PIFA resembles an inverted "F", comprising a top conducting plane 211, a bottom ground plane 403 and a shorting pin or post 407 connecting the top and bottom planes. The PIFA resonates at a quarter-wavelength due to the shorting pin 407, as discussed in greater detail below. The impedance of the PIFA can be controlled via the distance of the feed 405 to the shorting pin 407 (the closer the feed is to the shorting pin the less the impedance while increasing impedance is accomplished by moving the feed point farther from the shorting pin).

Figure 4:
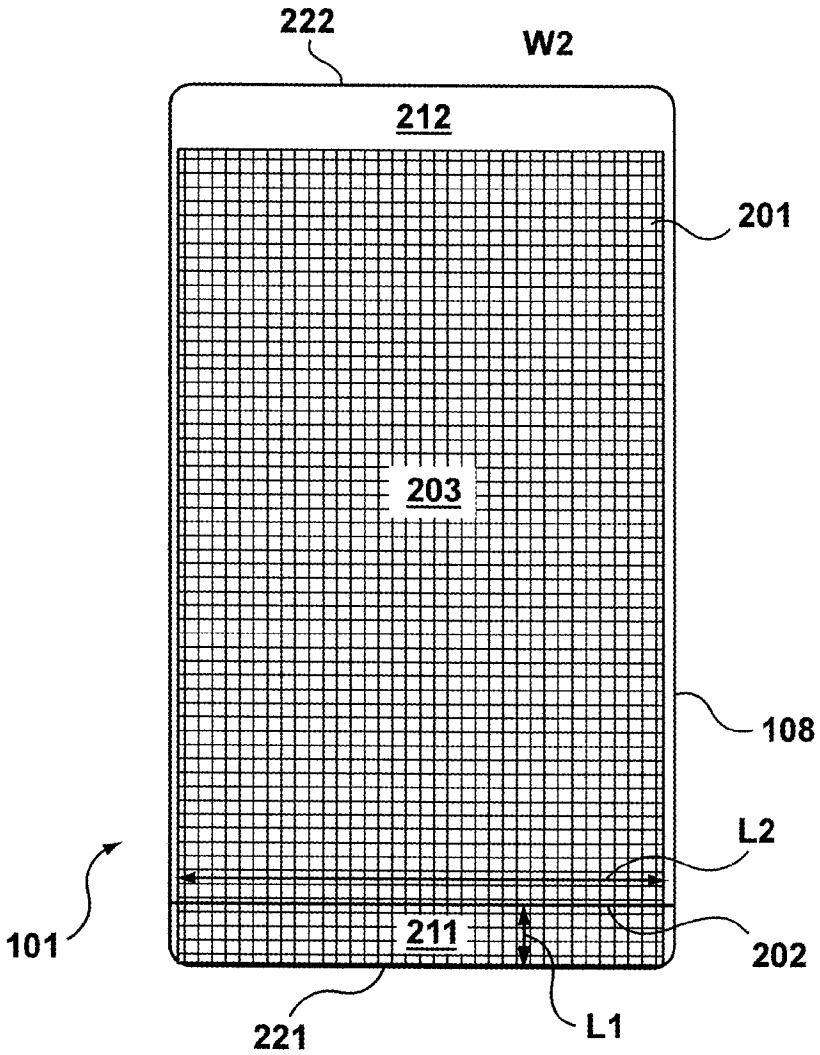
FIG. 4 depicts an exterior plan view of the back cover of the device of FIG. 1, showing an antenna conducting plane of the PIFA depicted in FIG. 3, according to a non-limiting implementation.

Attention is next directed to FIG. 4 which depicts a perspective view of a back of device 101 that includes a back cover 201 of device 101. Back cover 201 can comprise a component of chassis 109, and is generally attachable to a remaining portion of device 101, including, but not limited to, a front portion of chassis 109 depicted in FIG. 1 and/or an internal chassis. For example, back cover 201 can be removabley attached to device 101 so that a battery of device 101 can be accessed.

In any event, back cover 201 comprises a conducting central portion 203; a further conducting portion 211 separated from portion 203 by a thin gap 202 which, in one non-limiting embodiment, is 10 mm, wherein further conducting portion 211 comprises the conducting plane of antenna 111, and is of a first dimension L1 from first end edge 221 of back cover 201 to the gap 202 and a second dimension L2 between opposite sides of the metal edge ring 108; and an optional non-conducting portion 212. Conducting portions 203 and 211 can comprise one or more conducting materials, including, but not limited to, one or more metals. However, conducting plastics, conducting polymers, and the like are within the scope of present implementations. Non-conducting portion 212 can comprise one or more of plastic, polymer and/or any other suitable non-conducting material.

In some implementations back cover 201 can be flexible so that one or more latches, hooks, and the like of back cover 201 can be undone to remove back cover 201 from device 101.

In some implementations, back cover 201 can further comprise a non-conducting chassis, wherein non-conducting portion 212 comprises an end of the non-conducting chassis. However, other structures of back cover 201 are within the scope of present implementations; for example, non-conducting portion 212 can comprise a non-conducting cap connected to conducting central portion 203 using any combination of attachment devices, glues, and the like.

In some implementations, as depicted, conducting portion 203 covers about 80% of back cover 201. However, in other implementations, conducting portion 203 can cover more or less than 80% of back cover 201. However, conducting portion 211 is of a size that enables antenna 111 to operate within a specification in the operating frequency ranges.

Figure 5:
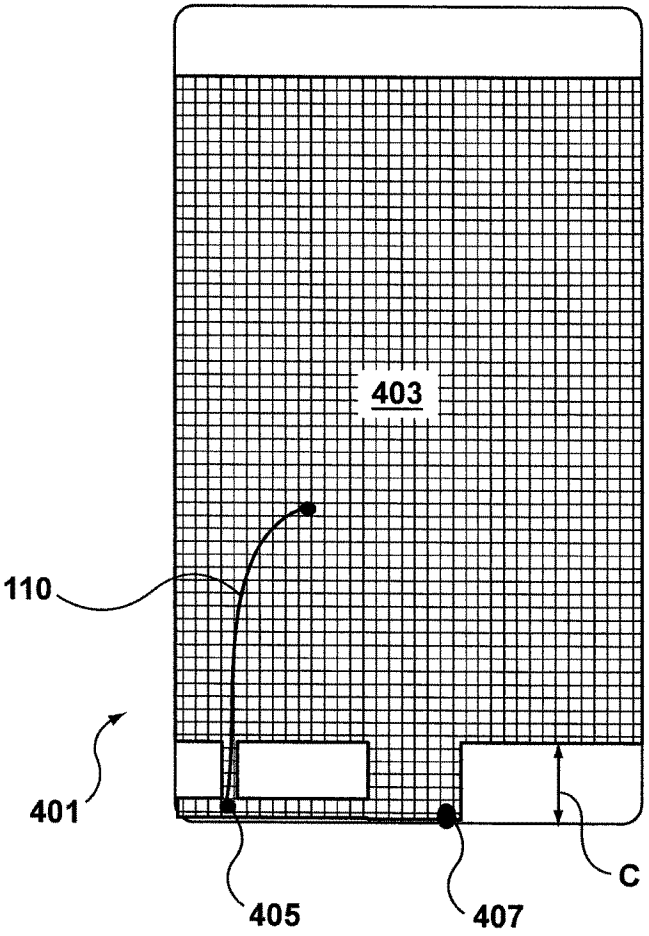
FIG. 5 depicts an interior plan view of the back cover of the device of FIG. 1, showing an antenna ground plane, feed point and shorting pin of the PIFA depicted in FIG. 3.

Attention is next directed to FIG. 5 which depicts an interior chassis 401 of device 101. In general, interior chassis 401 is internal to device 101 and is covered by back cover 201. Interior chassis 401 can comprise a non-conducting material including, but not limited to, plastics, polymers and the like. Furthermore, interior chassis 401 can act as a substrate for other internal components of the device including, but not limited to processor 120, memory 122, antenna feed 110, interface 124, and the like, as well as one or more PCBs (printed circuit boards), computer buses, and the like. Such components can be located, for example, in an area behind conducting central portion 203 of back cover 201.

The interior chassis 401 is adjacent a conducting ground plane 403 that can, in some implementations, be of similar dimensions to the conducting central portion 203. In the illustrated embodiment, the interior chassis 401 is covered on one side by the back cover 201 and on an opposite side by the conducting ground plane 403 such that the antenna conducting plane and ground plane wrap around the chassis and components mounted thereon. In another non-limiting embodiment (not shown), the conducting ground plane 403 is on an inside surface of the back cover 201 and adjacent the interior chassis 401. The ground plane 403 provides a common ground voltage for the various internal components of device 101, and also acts as the PIFA ground plane.

Antenna feed 110 is of co-ax design, with an outer sheet thereof in contact with and therefore grounded by the conducting ground plane 403, and an inner line carrying RF signals from interface 124 (typically disposed on the interior chassis 401), through a via hole 405 to the conducting portion 211. The location where the feed point connects to the conducting portion 211 determines the impedance of the antenna 111.

The PIFA shorting pin 407 of antenna 111 extends from the ground plane 403 to the edge of the conducting portion 211.

In general, the resonant length of antenna 111 can be characterized by: L1+L2=λ/4 (assuming negligible width of the shorting pin 407). For example, if L1=10 mm, L2=10 cm, and the dielectric permittivity (∈) of the chassis 401 separating ground plane 403 from conducting portion 211 is 4, then the resonant frequency of antenna 111 is calculated as follows:

$$L1+L2=\lambda/4$$

$$0.01+0.1=c/4f\sqrt{\in}$$

$$0.11=3\times10^8/4f\sqrt{4}$$

$$f=3\times10^8/(4*0.11f\sqrt{4})=340.7\text{ MHz}$$

However, it will be appreciated that specific implementations may incorporate portions of the mobile device environment into the antenna, such that the dimensions and therefore the classical derivation of resonant frequency may vary from the mathematical expressions above, which are provided for illustration purposes only. For example, the placement of the shorting pin 407 also contributes to tuning of the antenna and its location can affect the length of L1 and L2, as well as the size and location of the gap 202.

Interior chassis 401 can comprise apertures, cut-outs and the like to accommodate other components of device 101, and the ground plane 403 includes cut-outs, as shown in FIG. 4, to accommodate a USB or other connection.

In the embodiment of FIGS. 4 and 5, the height "C" of the shorting pin 407 (i.e. ground clearance between the conducting portion 211 and ground plane 403) is 11 mm, the feed point is about 2-3 mm from the conducting portion 211, and the shorting pin 407 is adjacent an edge of a cut-out (e.g. reserved for locating a USB).

Figure 6:
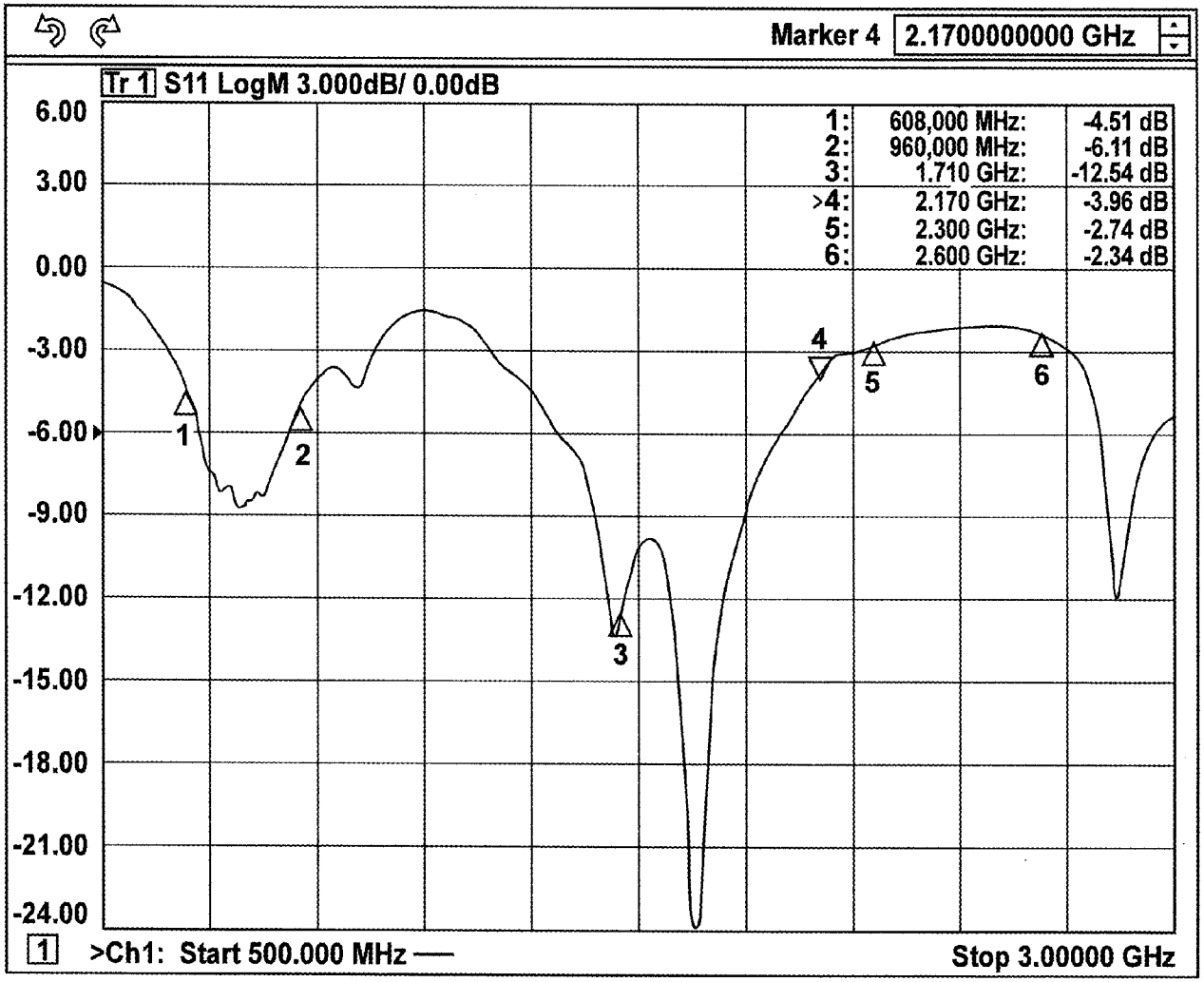
FIG. 6 is a graph showing measured S11 parameters for a prototype of the antenna according to a non-limiting implementation of FIGS. 4 and 5.

A prototype of the antenna according to the non-limiting embodiment of FIGS. 3 and 4 is characterized by the performance and efficiency results shown in FIGS. 5 and 6.

Figure 7:
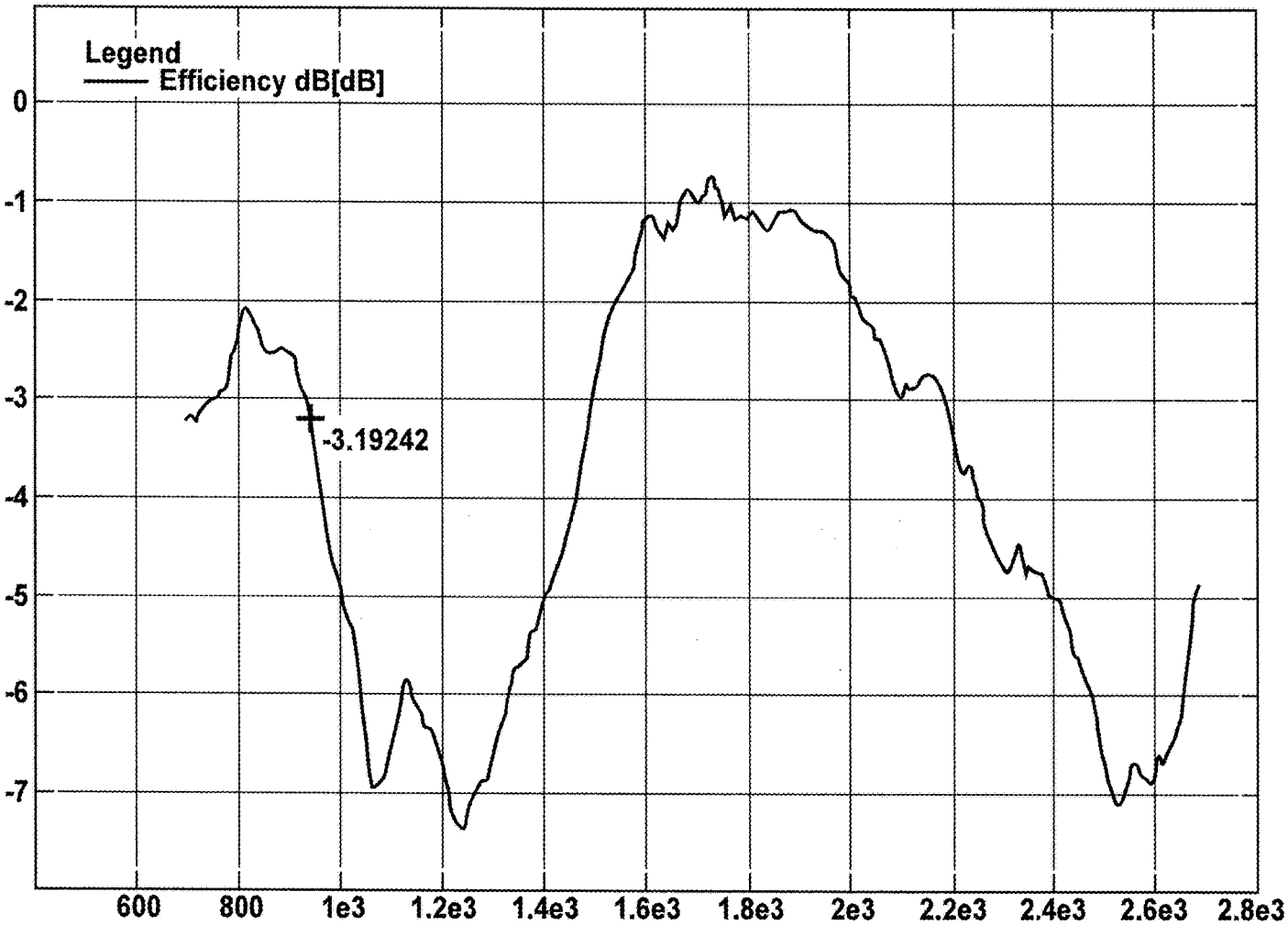
FIG. 7 is a graph showing measured efficiency for the prototype of the antenna according to a non-limiting implementation of FIGS. 4 and 5.

From FIG. 7, it will be noted that the antenna according to the non-limiting implementation of FIGS. 4 and 5, covers the low and mid band, with a measured efficiency about −3 dB above and a peak of −2 dB in the low band and −1 dB in the mid band.

Figure 8:
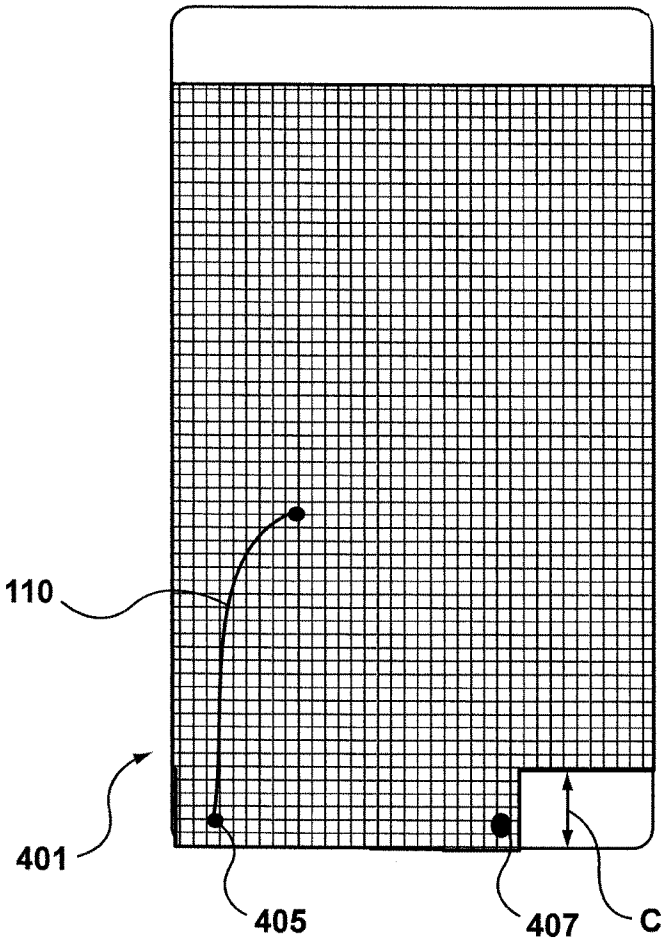
FIG. 8 depicts an interior perspective view of the back cover of the device of FIG. 1, according to an alternative non-limiting implementation of the PIFA depicted in FIG. 3.

Turning to FIG. 8, an alternative design of back cover 201 is shown where like numerals depict similar elements in FIG. 5.

In the embodiment of FIGS. 4 and 8, the height "C" of the shorting pin 407 (i.e. ground clearance between the conducting portion 211 and ground plane 403) is 12 mm, and the placement of the feed point and shorting pin are as shown in FIG. 5.

Figure 9:
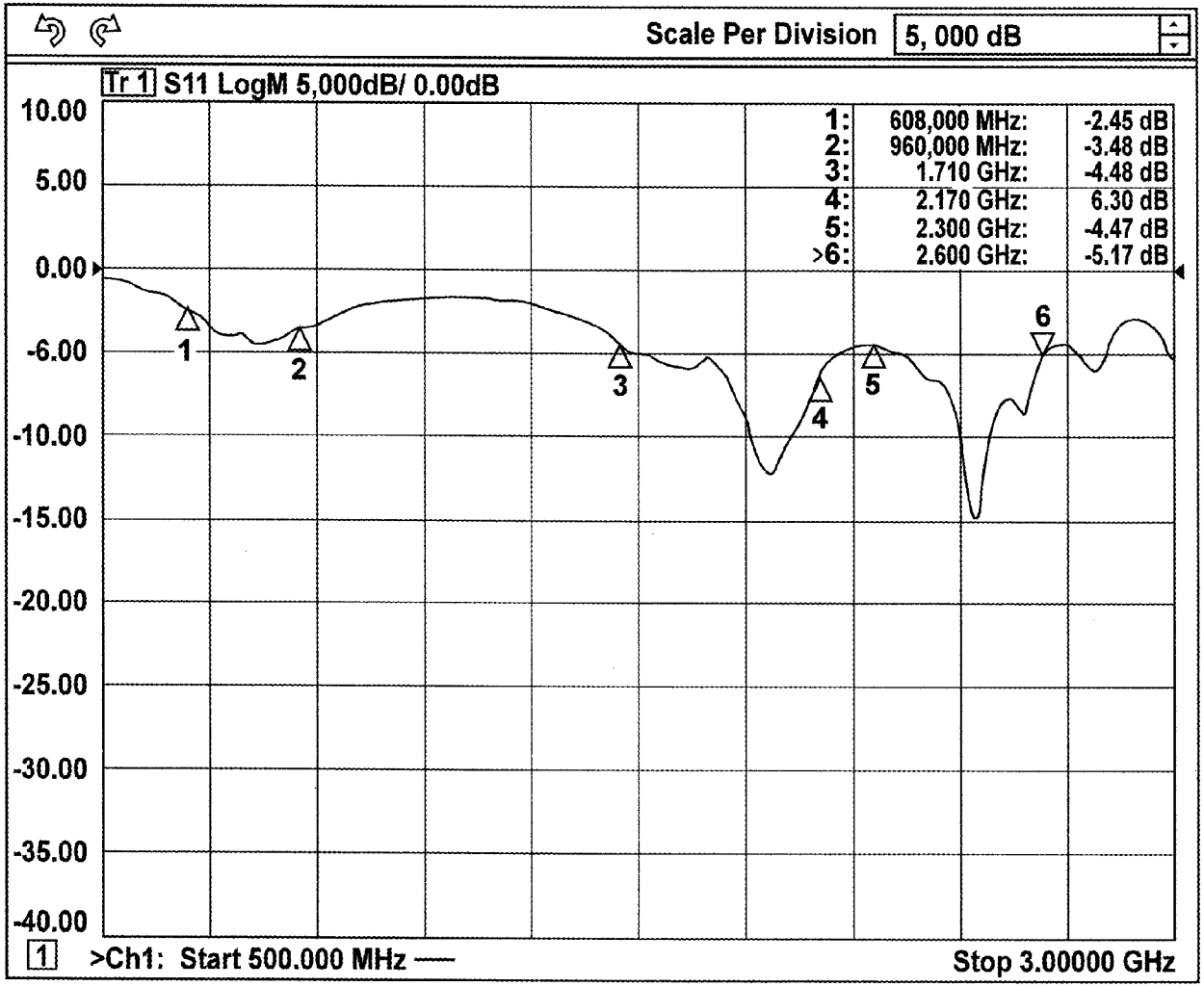
FIG. 9 is a graph showing measured S11 parameters for a prototype of the antenna according to a non-limiting implementation of FIGS. 4 and 8.
Figure 10:
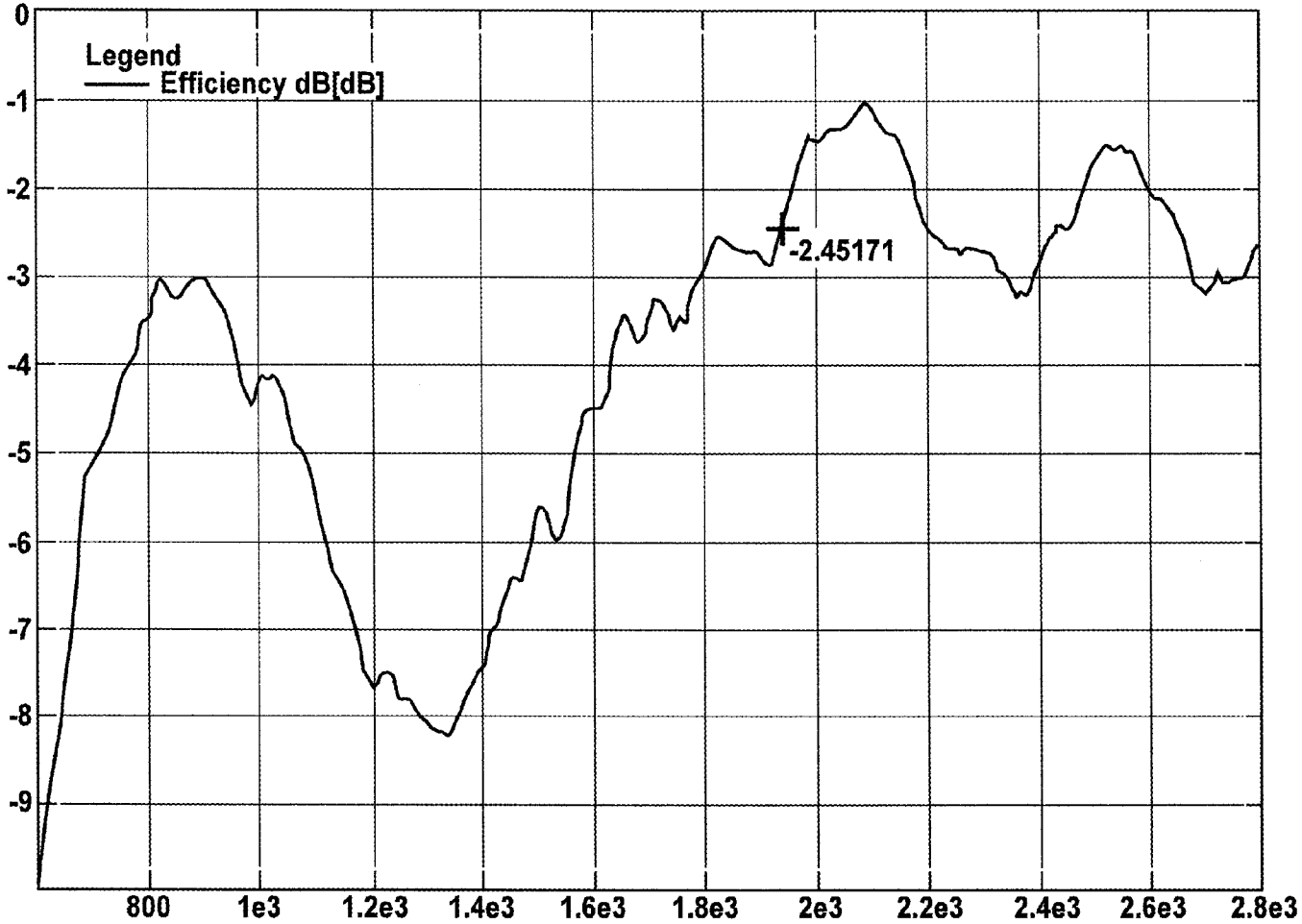
FIG. 10 is a graph showing measured efficiency for the prototype of the antenna according to a non-limiting implementation of FIGS. 4 and 8.
Figure 11:
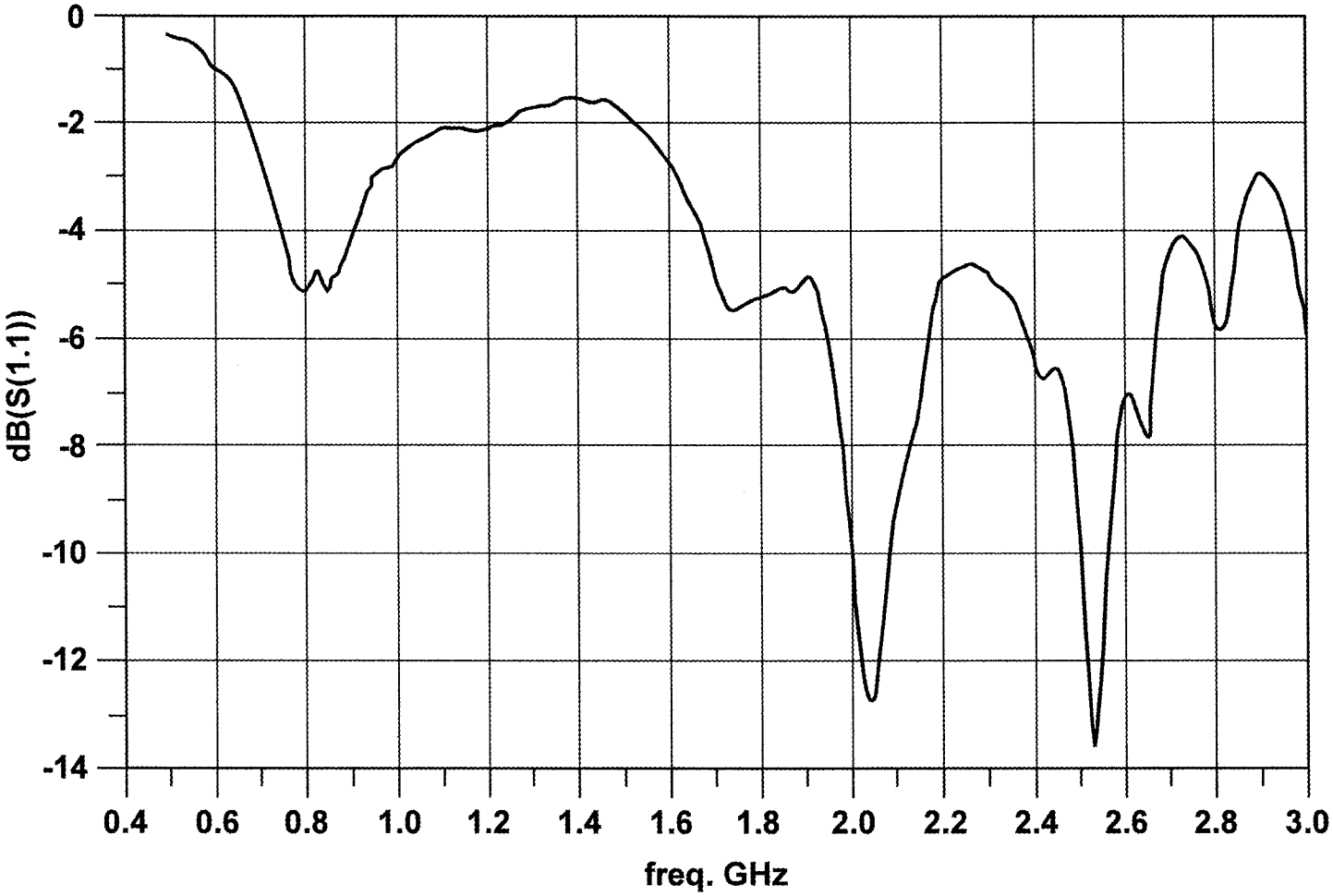
FIG. 11 is a graph showing measured S11 parameters for a prototype of the antenna according to non-limiting implementation of FIGS. 4 and 8, showing improved performance in the low band after further matching and tuning for carrier aggregation.

A prototype of the antenna according to the non-limiting embodiment of FIGS. 3 and 7 is characterized by the S11 performance and efficiency results shown in FIGS. 9-11.

As shown in FIG. 10, the antenna covers all bands, with a measured peak efficiency of −3 dB in the low band, −1 dB in the middle band, and −1.5 dB in the high band.

Matching and tuning can be further performed to achieve designated radiation performance at certain frequency bands that are required by carrier aggregation. For example, a matching network of passive components can be added between the antenna feed 110 and antenna 111 which, in conjunction with tuning of the antenna components, provides the S11 results depicted in FIG. 11, showing improved performance in the low band.

A portion of the disclosure of this patent document contains material which is subject to copyright protection. The copyright owner has no objection to the facsimile reproduction by any one of the patent document or patent disclosure, as it appears in the Patent and Trademark Office patent file or records, but otherwise reserves all copyrights whatsoever.

Persons skilled in the art will appreciate that there are yet more alternative implementations and modifications possible, and that the above examples are only illustrations of one or more implementations. The scope, therefore, is to be limited by the claims appended here.

What is claimed is:

1. A device comprising:

a back cover having a conducting central portion and a further conducting portion on an exterior thereof, the further conducting portion being separated from the central portion by a gap;

a conducting ground plane interior to the back cover;

an interior chassis having one side covered by the back cover and an opposing side covered by the conducting ground plane;

a metal edge ring surrounding the interior chassis and having a first portion separated from a second portion by said gap, the second portion adjacent to the further conduction portion, wherein the second portion of the metal edge ring and the further conducting portion on the exterior of the back cover comprise an antenna conducting plane;

an antenna feed connected to the antenna conducting plane; and a shorting pin connecting the ground plane to the antenna conducting plane.

2. The device of claim 1, wherein the further conducting portion is of a first dimension L1 from a first edge of the back cover to the gap and a second dimension L2 between opposite sides of the metal edge ring.

3. The device of claim 1, further comprising a via hole for the antenna feed to extend through the ground plane to the antenna conducting plane.

4. The device of claim 1, wherein the back cover is flexible and includes means for attaching and detaching the back cover therefrom.

5. The device of claim 1, wherein the back cover further comprises a non-conducting portion opposite said conducting portion.

6. The device of claim 3, wherein the antenna feed comprises a co-ax cable having an outer sheet thereof in contact with and grounded by the conducting ground plane, and an inner line carrying RF signals through the via hole to the antenna conducting plane.

7. The device of claim 6, wherein the RF signals comprise at least three frequency ranges, wherein:

a first one of the at least three frequency ranges comprise one or more of:

about 698 MHz to about 960 MHz; an LTE (Long-Term Evolution) frequency range; and LTE700 frequency range;

a second one of the at least three frequency ranges comprises one or more of:

about 1710 to about 2170 MHz, a GSM (Global System for Mobile Communications) frequency range; a CDMA (Code Division Multiple Access) frequency range; a PCS (Personal Communications Service) frequency range; and a UMTS (Universal Mobile Telecommunications System) frequency range; and, a third one of the at least three frequency ranges comprises one or more of: about 2300 to about 2690 MHz, another GSM (Global System for Mobile Communications) frequency range; another CDMA (Code Division Multiple Access) frequency range; another PCS (Personal Communications Service) frequency range; and another UMTS (Universal Mobile Telecommunications System) frequency range.

8. The device of claim 1, wherein the ground plane includes cut-outs to accommodate components mounted to the interior chassis.

9. The device of claim 1, wherein the antenna feed extends through the ground plane to the antenna conducting plane.

10. A device comprising:

a metallic back cover having an interior portion and exterior portion;

a chassis disposed on the interior portion of said metallic back cover for mounting components;

a metallic edge ring surrounding the metallic back cover and the chassis;

a gap extending through the exterior portion of the back cover and through the metallic edge ring for dividing the metallic back cover into a conducting central portion and a further conducting portion and dividing the metallic edge ring into a first portion adjacent the conducting portion and a second portion adjacent the further conducting portion, wherein the further conducting ring of the metallic back cover and the second portion of the metallic edge ring comprise an antenna conducting plane;

a ground plane covering the chassis such that said antenna conducting plane and ground plane wrap around the chassis and components mounted thereon;

an antenna feed extending through the ground plane to the antenna conducting plane; and a shorting pin connecting the ground plane to the antenna conducting plane.

11. The device of claim 10, wherein the conducting plane is of a first dimension L1 from a first edge of the back cover to the gap and a second dimension L2 between opposite sides of the metallic edge ring.

12. The device of claim 10, further comprising a via hole for the antenna feed to extend through the ground plane to the antenna conducting plane.

13. The device of claim 10, wherein the back cover is flexible and includes means for attaching and detaching the back cover therefrom.

14. The device of claim 10, wherein the back cover further comprises a non-conducting portion on the exterior portion opposite the antenna conducting plane.

15. The device of claim 12, wherein the antenna feed comprises a co-ax cable having an outer sheet thereof in contact with and grounded by the ground plane, and an inner line carrying RF signals through the via hole to the antenna conducting plane.

* * * * *